US006975819B2

(12) United States Patent
Katamoto

(10) Patent No.: US 6,975,819 B2
(45) Date of Patent: Dec. 13, 2005

(54) IMAGE FORMING APPARATUS

(75) Inventor: Kohji Katamoto, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 52 days.

(21) Appl. No.: 10/683,695

(22) Filed: Oct. 9, 2003

(65) Prior Publication Data

US 2004/0071478 A1 Apr. 15, 2004

(30) Foreign Application Priority Data

Oct. 10, 2002 (JP) ..... 2002-297459

(51) Int. Cl.[7] ..... G03G 15/00
(52) U.S. Cl. ..... 399/82; 399/81; 399/85
(58) Field of Search ..... 398/81, 82, 83, 398/85; 358/500, 505, 515, 522; 382/168

(56) References Cited

U.S. PATENT DOCUMENTS 6,118,895 A 9/2000 Hirota et al.
6,804,033 B1 * 10/2004 Hara ..... 358/522

FOREIGN PATENT DOCUMENTS

| | | |
|---|---|---|
| JP | H08-251402 A | 9/1996 |
| JP | H08-251406 A | 9/1996 |
| JP | 2002-232697 A | 8/2002 |

* cited by examiner

*Primary Examiner*—Hoang Ngo
(74) *Attorney, Agent, or Firm*—David G. Conlin; David A. Tucker; Edwards & Angell, LLP

(57) ABSTRACT

An image forming apparatus is provided with a controller which distinguishes the type of original from image data obtained by prescanning an original image and selects image processing parameters suited to the type of original. When automatic image forming mode is selected, the controller outputs, depending on whether a user has selected monochrome or multi-color image processing operation, a control signal indicating whether or not to prescan the original image to obtain information necessary for distinguishing the type of original to an image scanning unit.

7 Claims, 10 Drawing Sheets

IMAGE FORMING APPARATUS

This Nonprovisional application claims priority under 35 U.S.C. § 119(a) on Patent Application No. 2002-297459 filed in Japan on Oct. 10, 2002, the entire contents of which are hereby incorporated by reference.

BACKGROUND OF THE INVENTION

1. Field of the Invention

The present invention relates to an image forming apparatus designed to offer a capability to form an image of an original quickly and accurately based on its image data.

2. Description of the Related Art

The tendency in recent years has been to implement multi-color features in copying machines and printers. Image forming apparatuses featuring both multi-color and monochrome (black-and-white) image forming functions in a single unit are in widespread use today. An image forming apparatus featuring the monochrome and multi-color functions includes an image processing unit which produces a digital image signal from a scanned original image through a photoelectric conversion process. The image forming apparatus of this kind has image processing capabilities to properly cope with a wide variety of originals which include a full-color original, a unicolor original, an original carrying characters (printed text) and line art, a photographic original (printed on photographic printing paper), printed material (an original containing a halftone dot pattern) and an original containing halftone areas and line art, such as a map.

Conventionally known image forming apparatuses usually have keys on an operator panel to enable an operator to specify types of originals so that the apparatus can correctly read various types of original images and produce printed images of high quality. While the apparatus can set appropriate parameters suited for performing image forming operation with each type of original if the operator correctly operates the keys for specifying original types, some technical knowledge is needed for distinguishing the types of individual originals. However, the operator is often unable to distinguish the types of originals and occasionally specifies an incorrect type. It is therefore often impossible to obtain satisfactory printed images.

A previous approach to the resolution of the aforementioned problem is to develop an image forming apparatus provided with an image processing unit which can distinguish types of originals by itself, so that the operator is relieved of the need to distinguish individual original types, as proposed in Japanese Laid-open Patent Publication Nos. 1996-251402 and 1996-251406, for example.

Another previous approach is found in Japanese Laid-open Patent Publication No. 2002-232708 which discloses an image forming apparatus having a capability to automatically distinguish various types of originals including multi-color and monochrome originals with high accuracy by a simple method using image area separating means, thereby avoiding an increase in the scale of circuitry.

Generally, the image forming apparatus featuring both monochrome and multi-color image forming capabilities handles monochrome originals more frequently than multi-color originals, so that an important performance criterion in monochrome image forming is high processing speed. In contrast, great importance placed on the quality of printed images, rather than speed, in multi-color image forming.

When automatic image forming mode is selected in the aforementioned image forming apparatus of the prior art, it prescans an original to determine whether the original is a multi-color original or a monochrome (black-and-white) original. This image forming apparatus automatically prescans not only multi-color originals but also monochrome originals for which high-speed processing is of great performance, requiring a long time before printed images are obtained.

It is often the case that this kind of image forming apparatus is initially placed in the automatic image forming mode by default. If the image forming apparatus is so preset, it will automatically prescan each original, even if it is monochromatic, making it impossible to perform high-speed image processing regardless of the operator's intention.

SUMMARY OF THE INVENTION

In view of the foregoing, it is an object of the invention to provide an image forming apparatus which can perform image forming operation at high speed and with high accuracy by leaving a judgment as to whether an original is a monochrome or multi-color original to an operator and otherwise judging the type of original automatically.

According to the invention, an image forming apparatus includes a selector for allowing a user to select whether to perform monochrome or multi-color image processing operation on image data obtained by scanning an original image, an automatic image forming mode setting section for defining image forming conditions including such parameters as copying density which are automatically set in automatic image forming mode, and a controller for outputting, depending on whether the user has selected the monochrome or multi-color image processing operation through the selector, a control signal indicating whether or not to prescan the original image for distinguishing the type of original when the automatic image forming mode is selected to use the image forming conditions defined in the automatic image forming mode setting section.

The image forming apparatus thus constructed determines by itself whether or not to prescan the original image depending on whether the user has selected the monochrome or multi-color image processing operation by key operation, for example, when the automatic image forming mode is selected by user intervention or by default. This construction makes it possible to properly perform processes in individual modes of image forming operation.

When monochrome image processing mode is selected, for example, the image forming apparatus is caused to immediately scan the original image without prescanning it. This makes it possible to reduce the time needed for performing the image forming operation. When multi-color image processing mode is selected, on the other hand, appropriate image processing parameters are selected upon distinguishing the type of original based on image data obtained by prescanning the original image, so that the image forming apparatus can produce a high-quality printed image.

In one aspect of the invention, the selector includes a first selector portion (monochrome start key) for selecting the monochrome image processing operation, and a second selector portion (multi-color start key) for selecting the multi-color image processing operation, wherein the first and second selector portions serve also as image processing starting devices (start keys) for initiating the image forming operation.

In this construction, the user can instantly identify the monochrome and multi-color start keys without the need for looking around for a dedicated key for switching between the monochrome and multi-color image processing modes.

Since the first and second selector portions serve as image processing start keys, the monochrome or multi-color image processing operation begins at the same time that the monochrome or multi-color image processing mode is selected by pressing one of these start keys, resulting in an improvement in operability.

In another aspect of the invention, the controller causes the image forming apparatus to perform the image forming operation using predefined monochrome image processing parameters when the user has selected the monochrome image processing operation through the selector.

In this construction, the image processing parameters suited for the image forming operation are preset, so that the image forming apparatus can instantly perform the image forming operation in a proper fashion when the user has selected the monochrome image processing mode. This serves to significantly reduce the time needed for image processing, enabling quick and efficient execution of the image forming operation. The monochrome image processing parameters may be selected from multiple sets of predefined image processing parameters prepared for text and printed matter photograph mode, text and photographic paper print mode and text mode, for example.

In still another aspect of the invention, the controller includes a region discriminating section for separating image data obtained by prescanning the original image into multiple image regions having different attributes representing types of images such as text, halftone dot and background. The controller selects image processing parameters from multiple sets of predefined image processing parameters based on image quantity values of the individual image regions into which the prescanned image data has been separated by the region discriminating section when the user has selected the multi-color image processing operation through the selector, and the controller causes the image forming apparatus to perform the image forming operation using the selected image processing parameters.

In this construction, the region discriminating section separates the image data obtained by prescanning the original image into image regions having different features and calculates the image quantity values of the individual image regions. Then, the image forming apparatus determines the type of original based on the result of this region discriminating process and selects appropriate image processing parameters. With this arrangement, the image forming apparatus can produce high-quality printed images without the need for user selection of complicated image processing modes.

These and other objects, features and advantages of the invention will become more apparent upon reading the following detailed description in conjunction with the accompanying drawings.

DETAILED DESCRIPTION OF THE PREFERRED EMBODIMENTS OF THE INVENTION

Image forming apparatuses according to specific embodiments of the present invention are now described in detail referring to the accompanying drawings.

Image Forming Apparatus

Figure 1:
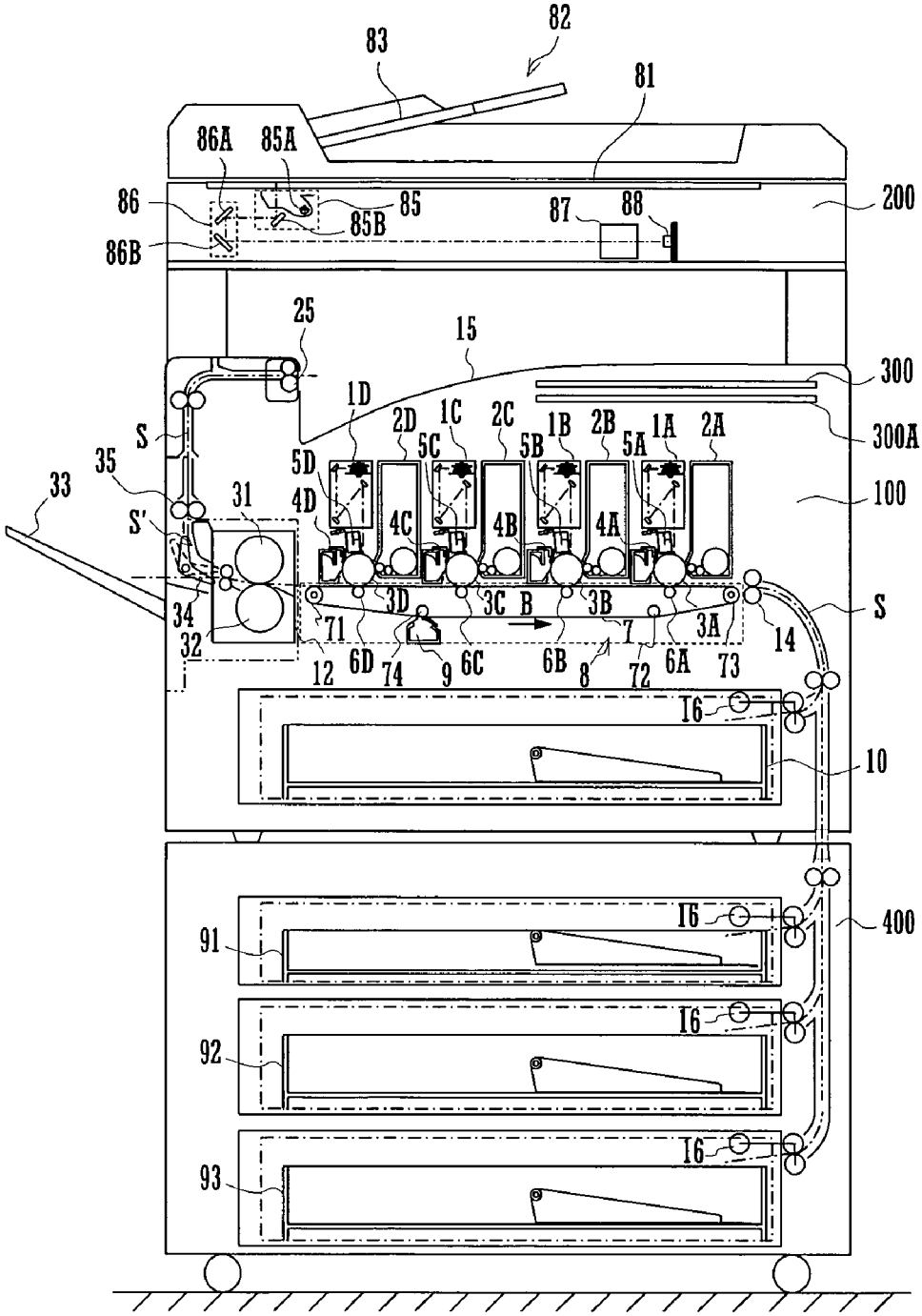
FIG. 1 is a diagram showing the construction of a hybrid machine including an image forming apparatus according to an embodiment of the invention.
Figure 2:
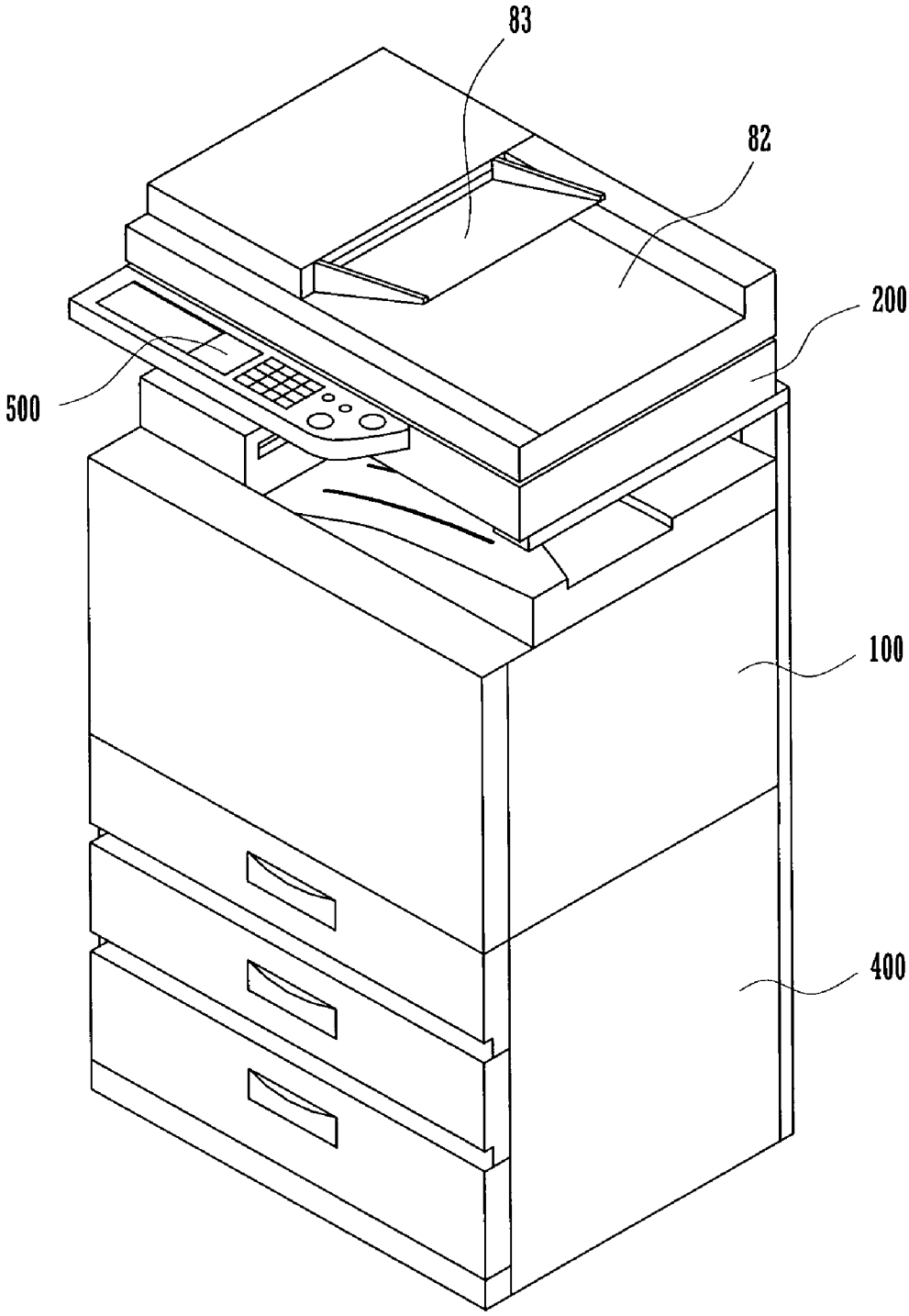
FIG. 2 is a perspective view of the hybrid machine of FIG. 1.

FIG. 1 shows the internal construction of a hybrid machine including an image forming apparatus 100 according to an embodiment of the invention, and FIG. 2 shows the external appearance of the hybrid machine.

The image forming apparatus 100 produces a monochrome or multi-color image on a sheet of printing paper according to image data picked up by an image scanning unit 200 or received from an external source. The image forming apparatus 100 includes exposure units 1, developing units 2, photosensitive drums 3, cleaning units 4, charging units 5, an image transfer belt unit 8, a fuser unit 12, a paper transport path S, a paper tray 10, a first delivery tray 15 and a second delivery tray 33.

The image forming apparatus 100 processes image data which may contain black (K), cyan (C), magenta (M) and yellow (Y) components forming a color image. Accordingly, there are provided four each exposure units 1 (1A, 1B, 1C, 1D), developing units 2 (2A, 2B, 2C, 2D), photosensitive drums 3 (3A, 3B, 3C, 3D), cleaning units 4 (4A, 4B, 4C, 4D) and charging units 5 (5A, 5B, 5C, 5D) constituting four color imaging modules arranged in tandem as illustrated to produce four color-separated latent images and convert them into black, cyan, magenta and yellow images. The suffixes "A", "B", "C" and "D" added to the reference numerals designate the units for black, cyan, magenta and yellow, respectively.

The photosensitive drums 3 are mounted approximately at the middle of the image forming apparatus 100. The charging units 5 are electrostatic chargers for imparting a uniform electrostatic charge on surfaces of the photosensitive drums 3. The charging units 5 may employ roller- or brush-type charging electrodes which are in direct contact with the drum surfaces or noncontact charging wires, for example.

Each exposure unit 1 may be of a type employing an electroluminescent (EL) display or a light emitting diode (LED) writing head formed of an array of light emitting elements, or a laser scanning unit (LSU) including a laser projector and a reflecting mirror, for example. As the photosensitive drums 3 are exposed to light according to input image data, electrostatic latent images corresponding to the image data are formed on the photosensitive drum surfaces.

The developing units 2 visualizes the electrostatic latent images by converting them into black, cyan, magenta and yellow images with color toners (black, cyan, magenta and yellow) adhering to charged areas on the drum surfaces. The cleaning units 4 remove and collect residual toners from the drum surfaces upon completion of development and image transfer processes.

The image transfer belt unit 8 located beneath the photosensitive drums 3 includes an image transfer belt 7, a driving roller 71, a belt tension roller 72, a driven roller 73, a belt support roller 74, image transfer rollers 6 (6A, 6B, 6C, 6D) and an image transfer belt cleaning unit 9.

The driving roller 71, the belt tension roller 72, the image transfer rollers 6, the driven roller 73 and the belt support roller 74 together work to give tension to the image transfer belt 7 and turn it in the direction of an arrow B shown in FIG. 1. Rotatably supported by a frame (not shown) inside the image transfer belt unit 8, the image transfer rollers 6 transfer color-separated toner images formed on the individual photosensitive drums 3 onto a sheet (printing medium) which is attracted to and transported by the image transfer belt 7.

The image transfer belt 7 is in contact with the individual image transfer rollers 6 except when any printing paper lies on the image transfer belt 7. As the image transfer belt 7 carries a sheet of printing paper along the photosensitive drums 3, the color-separated toner images on the individual drums 3 are successively transferred one on top of another onto the sheet to produce a multi-color toner image. The image transfer belt 7 is an endless belt made of a film approximately 100 micrometers thick.

The toner images on the photosensitive drums 3 are transferred onto the sheet by the image transfer rollers 6 which are located on the bottom side of the image transfer belt 7 in direct contact therewith. A positive high voltage is applied to the image transfer rollers 6 to transfer the toner images formed of negatively charged toner particles onto the sheet.

Each image transfer roller 6 includes a metallic shaft made of stainless steel, for example, measuring approximately 8 to 10 mm in diameter and an electrically conductive coating formed of an elastic material, such as ethylene-propylene-diene terpolymer (EPDM) or urethane foam. With this electrically conductive elastic coating covering an outer surface of the metallic shaft, it is possible to uniformly apply the high voltage to the sheet. While the image transfer rollers 6 are used as image transfer electrodes in this embodiment, it is possible to employ alternative forms of image transfer electrodes, such as brushes.

Toner powder adhering to the image transfer belt 7 is removed and collected by the image transfer belt cleaning unit 9 since the adhering toner powder could smear the reverse side of the printing paper. As an example, the image transfer belt cleaning unit 9 includes a cleaning blade which is in contact with the image transfer belt 7, and the image transfer belt 7 is forced against the cleaning blade by the belt support roller 74 from the opposite side.

The paper tray 10 is provided beneath an image forming section of the image forming apparatus 100 to hold a stack of sheets used for printing images. The first delivery tray 15 located at the top of the image forming apparatus 100 holds sheets carrying printed images face down. The second delivery tray 33 attached to one side of the image forming apparatus 100 holds sheets carrying printed images face up.

The paper transport path S provided inside the image forming apparatus 100 is a generally S-shaped paper path for transporting each sheet of printing paper from the paper tray 10 to the first delivery tray 15 through the image transfer belt unit 8, the fuser unit 12, etc. There are provided a pickup roller 16, registration rollers 14, the fuser unit 12, a transport direction switching gate 34, transport rollers 25 for transporting the sheet, and so on along the paper transport path S from the paper tray 10 to the first delivery tray 15 and the second delivery tray 33.

The transport rollers 25 are multiple pairs of small-sized rollers located along the paper transport path S for guiding the sheet being transported. The pickup roller 16 is a friction roller installed at one end of the paper tray 10 to pull and feed one sheet after another from the paper tray 10 into the paper transport path S.

The transport direction switching gate 34 is rotatably mounted on a side cover 35. When the transport direction switching gate 34 is flipped from a position shown by solid lines to a position shown by broken lines, the sheet is redirected halfway from the paper transport path S and ejected onto the second delivery tray 33. When the transport direction switching gate 34 is set in the position shown by the solid lines, the sheet is routed through a transport channel S' (which constitutes part of the paper transport path S) formed in the midst of the fuser unit 12, the side cover 35 and the transport direction switching gate 34 and discharged onto the first delivery tray 15.

The registration rollers 14 temporarily halt the sheet as it is being transported through the paper transport path S. The registration rollers 14 feed the sheet onto the image transfer belt 7 with proper timing in synchronism with rotating motion of the photosensitive drums 3 so that the toner images on the individual photosensitive drums 3 are correctly transferred onto the sheet without misalignment.

To ensure that the transferred images are in exact register, the registration rollers 14 are controlled based on a sensing signal fed from a registration detecting switch (not shown) to feed the sheet in such a manner that leading edges of the toner images on the individual photosensitive drums 3 aligns with a leading edge of an image forming area on the sheet being transported.

The fuser unit 12 includes a heat roller 31 and a pressure roller 32 which rotate with the sheet sandwiched in between. The heat roller 31 is heated to a specific fusing temperature based on a sensed temperature value detected by a temperature sensor (not shown) under the control of a controller (not shown). The heat roller 31 and the pressure roller 32 fuse and fix the multi-color toner image to the sheet with heat under pressure.

The sheet carrying the fixed multi-color toner image is guided through a sheet reversing channel (which constitutes part of the paper transport path S) by the transport rollers 25 and output onto the first delivery tray 15 face down.

Image Scanning Unit

Mounted on top of the image forming apparatus 100, the image scanning unit 200 includes platen glass 81 made of a transparent glass plate and an automatic document feeder (ADF) 82 located above the platen glass 81. The ADF 82 automatically feeds one sheet after another of an original document loaded on an original tray 83 onto the platen glass 81.

The image scanning unit 200 scans (or "reads") an image on an original placed on the platen glass 81 to obtain image data. The image scanning unit 200 further includes a first scanning assembly 85, a second scanning assembly 86, an optical lens 87 and a charge-coupled-device (CCD) line sensor 88 including photoelectric conversion elements. The first scanning assembly 85 includes an exposure lamp unit 85A for projecting light onto the original image and a first mirror 85B for reflecting an optical image reflected from the original in a specific direction. The second scanning assembly 86 includes a second mirror 86A and a third mirror 86B for guiding the optical image of the original from the first mirror 85B toward the CCD line sensor 88. The optical lens 87 focuses the optical image of the original on the CCD line sensor 88.

Working in association with the ADF 82, the image scanning unit 200 reads the image on the original automatically fed from the ADF 82 sends the image data obtained to an unillustrated image data input section of an image processing unit 300. The image processing unit 300 performs specific image processing operation on the image data and stores processed image data in an internal memory. The image processing unit 300 then reads the image data from the internal memory and transmits it to an unillustrated optical writing device in the image forming apparatus 100 in accordance with an output instruction. The image processing unit 300 includes an automatic image forming mode setting section for defining image forming conditions including copying density which are automatically set in automatic image forming mode.

The image processing unit 300 is provided with a controller 300A which distinguishes types of originals from the image data obtained from each original and sets up image processing parameters according to the type of original as will be later discussed in detail. When the automatic image forming mode is selected, the controller 300A outputs, depending on whether a user has specified multi-color image processing or monochrome image processing, a control signal to the image scanning unit 200 indicating whether or not to prescan the original to obtain information for distinguishing the type of original.

While the image scanning unit 200 provided with the ADF 82 in the illustrated example, the invention is not limited to this structure. As an alternative, the image scanning unit 200 may be of a type unprovided with any ADF.

The image forming apparatus 100 is mounted on top of an extra paper tray cabinet 400 as shown in FIG. 1. In this example, the extra paper tray cabinet 400 includes three paper trays 91, 92, 93 placed one on top of another. These paper trays 91, 92, 93 are provided with respective pickup rollers 16 so that sheets can fed one after another from any of the paper trays 91, 92, 93 into the paper transport path S of the image forming apparatus 100.

While the extra paper tray cabinet 400 includes the three paper trays 91, 92, 93 in the illustrated example, the image forming apparatus 100 may be furnished with alternative types of cabinet depending on user requirements. One alternative is a cabinet containing a single paper tray. Another is a tandem tray cabinet containing a pair of trays arranged in parallel. Still another alternative is one functioning simply as a supporting cabinet without any paper trays.

Operator Panel

Figure 3:
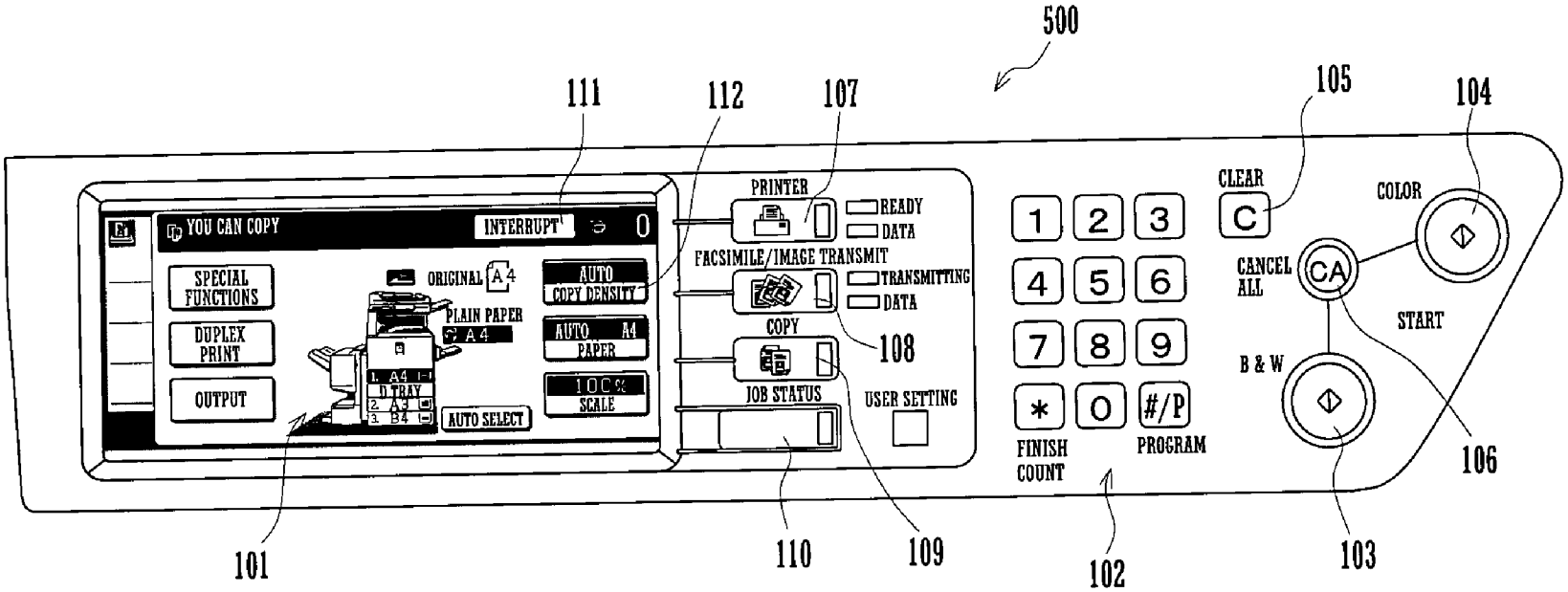
FIG. 3 is a plan view of an operator panel of the image forming apparatus of FIG. 1 showing a state in which automatic operation mode is selected.

FIG. 3 is a plan view of an operator panel 500 of the image forming apparatus 100. The operator panel 500 is located on the image scanning unit 200. The operator panel 500 includes in its left half a touch panel liquid crystal display (LCD) 101. Numeric keypad 102, a monochrome start key (black-and-white image processing start key) 103, a color start key (color image processing start key) 104, a clear key 105 and a cancel all key 106 are arranged on the right of the touch panel LCD 101.

The touch panel LCD 101 presents various pieces of information on its display screen which is switched from one page to another in response to user action, for instance. The touch panel LCD 101 shows touch keys which permit the user to enter various image forming conditions. The user can select automatic or manual settings, specify types of originals and printing paper as well as a scale factor (enlargement or reduction), call out special functions, and so on by directly pressing the touch keys on the touch panel LCD 101 with a finger. The touch panel LCD 101 also gives operating guidance and visual warnings.

Provided between the touch panel LCD 101 and the numeric keypad 102 are function select keys, such as a printer key 107, facsimile/image transmit key 108 and a copy key 109, for selecting one of functions of the image forming apparatus 100 serving as a hybrid (multi-function) machine as well as a job key 110 used for verifying status of jobs registered for the individual functions.

Among the various keys arranged on the right of the touch panel LCD 101, keys on the numeric keypad 102 are used for entering numeric values (e.g., the number of copies) on the touch panel LCD 101. The monochrome start key 103 and the color start key 104 are keys for entering commands for starting scanning and image forming operation in respective image processing modes (monochrome and color). Specifically, the individual start keys 103, 104 permit the user to select monochrome or color image processing and to enter a start command initiating the scanning and image forming operation. The clear key 105 is used to clear a set value displayed on the touch panel LCD 101 or to interrupt a process, such as an image forming process, currently in progress, whereas the cancel all key 106 is a key for nullifying the currently selected image processing mode, current settings of scanning and image forming conditions and other settings returning all of the user settings to default settings.

An interrupt key 111 shown on the touch panel LCD 101 is a key for interrupting the image forming operation or any other operation of the image forming apparatus 100 currently in progress to enable execution of image forming or other operation with different settings. In this embodiment, a function of selecting automatic or manual operation mode is assigned to a copying density key 112 shown on the touch panel LCD 101. FIG. 3 shows a state in which the automatic operation mode is selected. When the automatic operation mode is selected, the copying density applicable to the image forming operation and the density of an original image to be taken into account during scanning operation are automatically controlled according to the darkness of each original.

Figure 4:
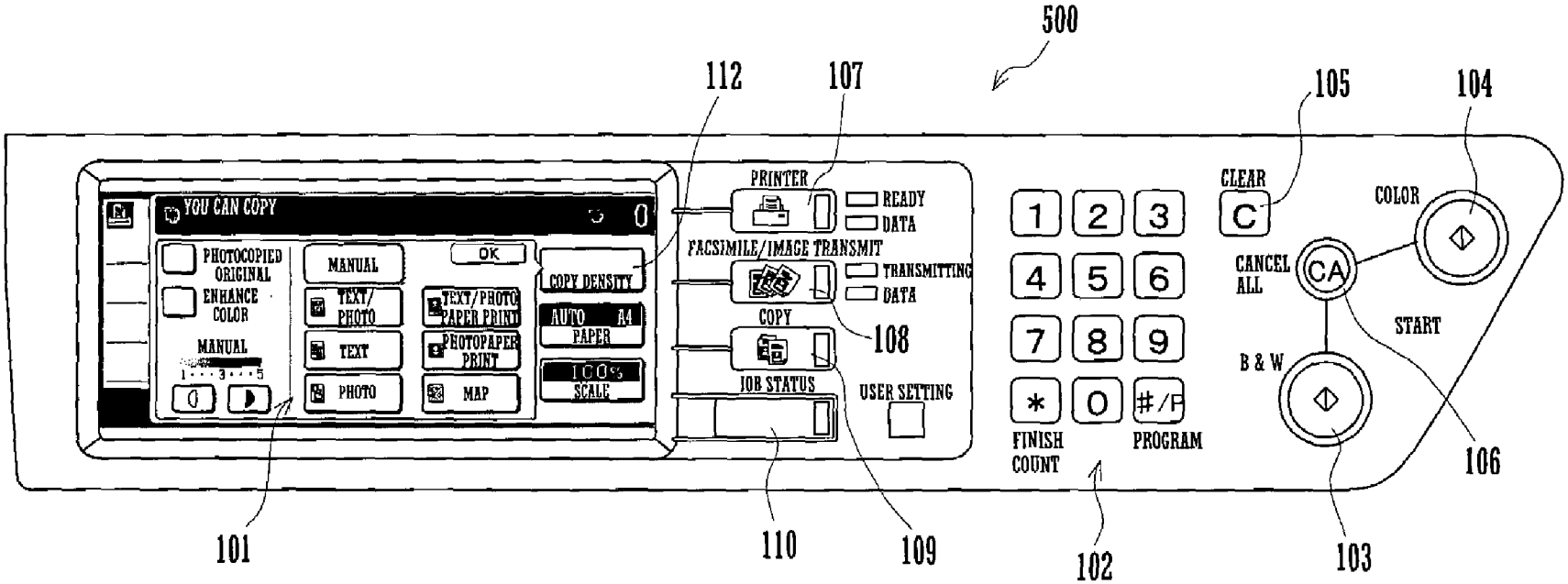
FIG. 4 is a plan view of the operator panel of the image forming apparatus of FIG. 1 showing a state in which manual operation mode is selected.

FIG. 4 shows a state in which the manual operation mode is selected. In this case, the touch panel LCD 101 displays multiple image processing modes for user selection of various types of originals as well as a density adjustment key to allow adjustment of the copying density applicable to the image forming operation and the density of each original to be taken into account during the scanning operation.

The touch panel LCD 101 also displays a key allowing selection of a "map mode" which is not automatically selected as an image processing mode. A map is an extraordinary original carrying an extremely low-density image. For this reason, the map mode is not included in automatically selected image processing modes. It may however be included in the automatically selected image processing modes in one modified form of the embodiment.

Alternative Operator Panel

Figure 5:
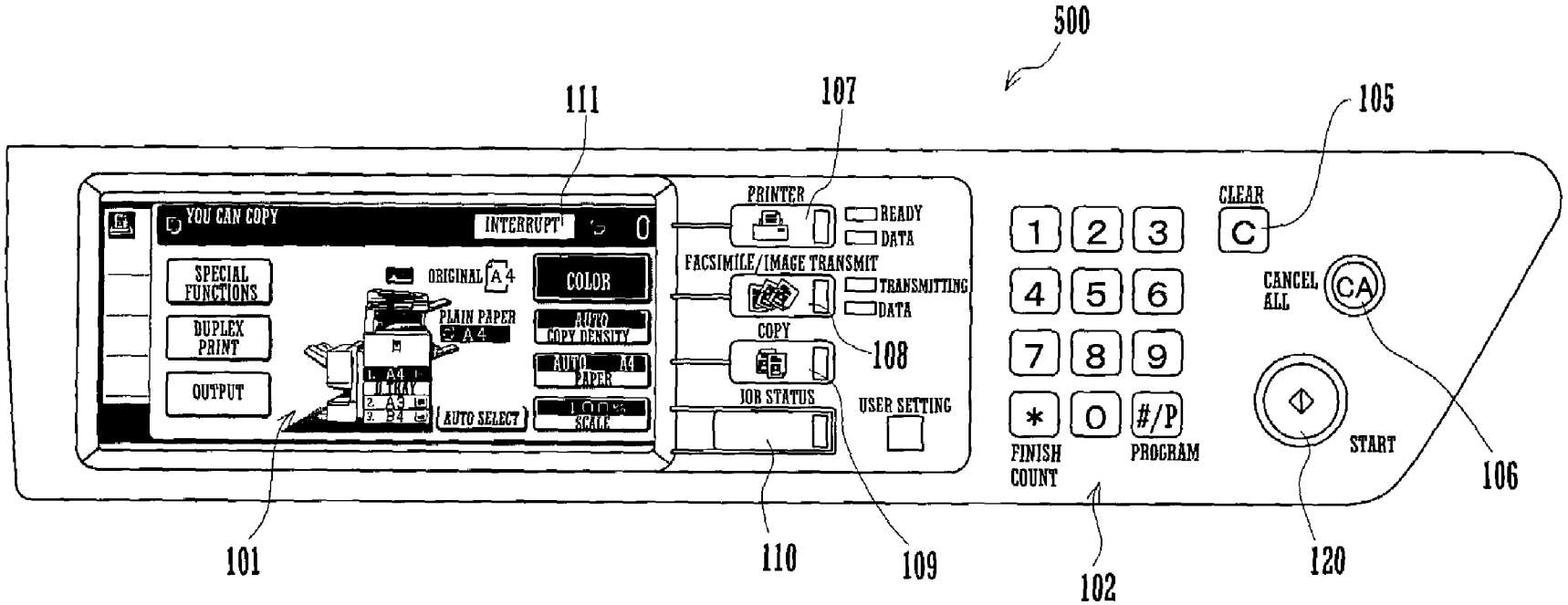
FIG. 5 is a plan view of an alternative operator panel of the image forming apparatus of FIG. 1.

FIG. 5 shows an operator panel 500 employing a single start key (image processing start key) 120. With this alternative operator panel 500, the user first presses the start key 120 and then selects monochrome (black-and-white) image processing mode or multi-color image processing mode on the touch panel LCD 101. Shown in FIG. 5 is a state in which the multi-color image processing mode is selected.

Image Processing Method

Monochrome image forming operation is usually used for reproducing documents at offices. While these documents mainly contain text, each document includes a large number of images (pages) in many cases. Although processing time needed for image forming per original is relatively short, a long processing time is often required for reproducing a complete document. It is therefore desirable that the monochrome image forming operation be performed with as high efficiency as possible. For this reason, monochrome image forming is often performed upon completion of binary data processing to ensure high-speed data transfer, data processing and image processing operation and to ensure that processing speed is not restricted by the capacity of an image data storage device installed in the image forming apparatus 100.

The monochrome image forming operation in the automatic operation mode (automatic image forming mode) is performed in automatic exposure mode in principle, in which the image forming apparatus 100 is usually preset to text and printed matter photograph mode with automatic exposure so that a successful image of an original like newspaper can be formed with its background taken into account. In the text and printed matter photograph mode, image data is processed in such a way that line art and halftone dot pattern are reproduced with high quality without sacrificing sharpness of printed text or producing any moir pattern. Therefore, the image data is processed using image processing settings that permit successful reproduction of both text and a photographic image on printed matter (halftone dot image) in the monochrome image forming operation in the automatic operation mode. Alternatively, the image data is processed using image processing settings individually established for specific regions of an original image.

Generally, the monochrome image forming operation in the automatic operation mode is most often performed for reproducing monochrome (black-and-white) originals containing text and photographic originals on printed matter. Therefore, the image forming apparatus 100 may be so constructed that it is automatically set to the text and printed matter photograph mode when the monochrome image forming operation is selected in the automatic operation mode. Some users would, however, most frequently handle photographic originals printed on photographic printing paper and originals containing text alone. Photographic images printed on photographic printing paper and images containing text alone tend to result in blurred printed images characterized by obscured edges (contours). For this reason, it is preferred to slightly enhance edges when reproducing the photographic images printed on photographic printing paper. It is also preferred to enhance edges of text when reproducing the images containing text to give sharp-edged printed characters. Accordingly, the image forming apparatus 100 permits the user to preset one of multiple image forming modes as a default mode. These image forming modes include, in addition to the aforementioned text and printed matter photograph mode, text and photographic paper print mode, text mode, printed matter photograph mode and photographic paper print mode, for example.

If the monochrome image processing mode is selected in the automatic operation mode as a result of user intervention or by default in the aforementioned manner, the image scanning unit 200 immediately scans an original image without prescanning it and the image forming apparatus 100 outputs a reproduced monochrome image by performing the image processing operation according to preset image processing parameters suited to the currently selected image forming mode. This approach of the embodiment serves to reduce total time needed for the image processing operation while ensuring desired image forming quality.

On the other hand, multi-color image forming operation is used for reproducing photographic images on printed matter and photographic images printed on photographic printing paper requiring representation of gradations in overwhelmingly most cases. In multi-color image forming, displeasing color irregularities tend to occur unless image processing method is switched between halftone dot images like the photographic images on printed matter and images involving continuous gradations like the photographic images printed on photographic printing paper. If wrong image processing settings are selected, considerable deterioration of image forming quality will result. Image processing such as color correction is performed in the multi-color image forming operation.

The multi-color image forming operation in the automatic operation mode is performed by judging the type of original and selecting image forming mode suited for forming an image of high quality through appropriate image forming operation. Specifically, the original image is prescanned and separated into regions having different image attributes based on image data obtained by prescan using a region discriminating process. The image forming apparatus 100 determines the type of original according to image quantity values (expressed in terms of the ratio of image quantities) in the individual regions and selects optimum image forming mode from the aforementioned text and printed matter photograph mode, text and photographic paper print mode, text mode, printed matter photograph mode and photographic paper print mode. Then, the image forming apparatus 100 performs the image forming operation in the image forming mode thus selected. The image forming apparatus 100 skips regions which have been judged to be a background of the original image in executing the image forming operation.

When switched from the automatic operation mode to the manual operation mode, the image forming apparatus 100 allows the user to select one of the aforementioned image forming modes. The image forming mode to which the image forming apparatus 100 is initially set when switched from the automatic operation mode to the manual operation mode may be image forming mode predefined as default mode, image forming mode previously selected and executed, or image forming mode determined based on how often the individual image forming modes have previously been executed. This initially activated image forming mode can be individually preset for the monochrome and multi-color image forming operation.

When the image forming apparatus 100 is powered on from an off state or left unused for a specific period of time, it is set (or reinitialized) to default operation mode. While the automatic operation mode is normally predefined as the default operation mode, the monochrome or multi-color image processing manual operation mode may be predefined as the default operation mode if it is so desired.

Image Processing Method for Alternative Operator Panel

The aforementioned image processing method can be used basically in the same way even when the operator panel 500 of FIG. 5 having the single start key 120 without the provision of the monochrome start key 103 and the color start key 104 is employed and the image forming apparatus 100 is switched between the monochrome image processing mode and the multi-color image processing mode on the touch panel LCD 101. If the start key 120 is pressed when the image forming apparatus 100 is set to the automatic operation mode, the image scanning unit 200 immediately begins to scan an original image in the case of the monochrome image processing mode and the image forming apparatus 100 outputs a reproduced monochrome image by performing the image processing operation using the image processing settings suited to the preset image forming mode. This approach serves to reduce total time needed for the image processing operation while ensuring desired image forming quality.

When the multi-color image processing mode is selected, on the other hand, the image scanning unit 200 prescans an original image and the image forming apparatus 100 determines the type of original. Next, the image forming apparatus 100 sets up image processing parameters appropriate for the image forming mode selected in accordance with the type of original and causes the image scanning unit 200 to scan the original image. The image forming apparatus 100 then performs the image processing operation and produces a multi-color printed image of high quality.

Selecting Image Processing Parameters Based on Result of Region Discriminating Process The image forming apparatus 100 may be constructed such that image processing parameters to be set when the multi-color image processing mode is selected can be chosen from multiple sets of predefined image processing parameters as appropriate according to the result of the region discriminating process performed on the image data obtained by prescanning the original image.

If the image forming apparatus 100 is so constructed, an optimum image processing parameter set can be selected based on the result of the region discriminating process, in which the image forming apparatus 100 separates the original image into multiple regions having different image attributes and determines image quantities contained in the individual regions. With this arrangement, the image forming apparatus 100 can perform the image processing operation in an optimum fashion and produce high-quality printed images without the need for user selection of the complicated image forming modes.

The region discriminating process for allowing this mode of selection of the image processing parameters can be carried out by a region discriminating section (refer to FIG. 6) provided in the image processing unit 300. To achieve this, the region discriminating section may be configured to work in the following fashion. For example, the region discriminating section extracts image data including data on aimed pixels in blocks of multiple pixels derived from the image data obtained by prescanning the original image in both main scanning and sub-scanning directions and determines image feature quantities in the individual blocks. The region discriminating section determines to which regions (text, halftone dot, background, photograph, etc.) the aimed pixels belong by comparing the image feature quantities with threshold values and thereby judges the type of original.

Figure 6:
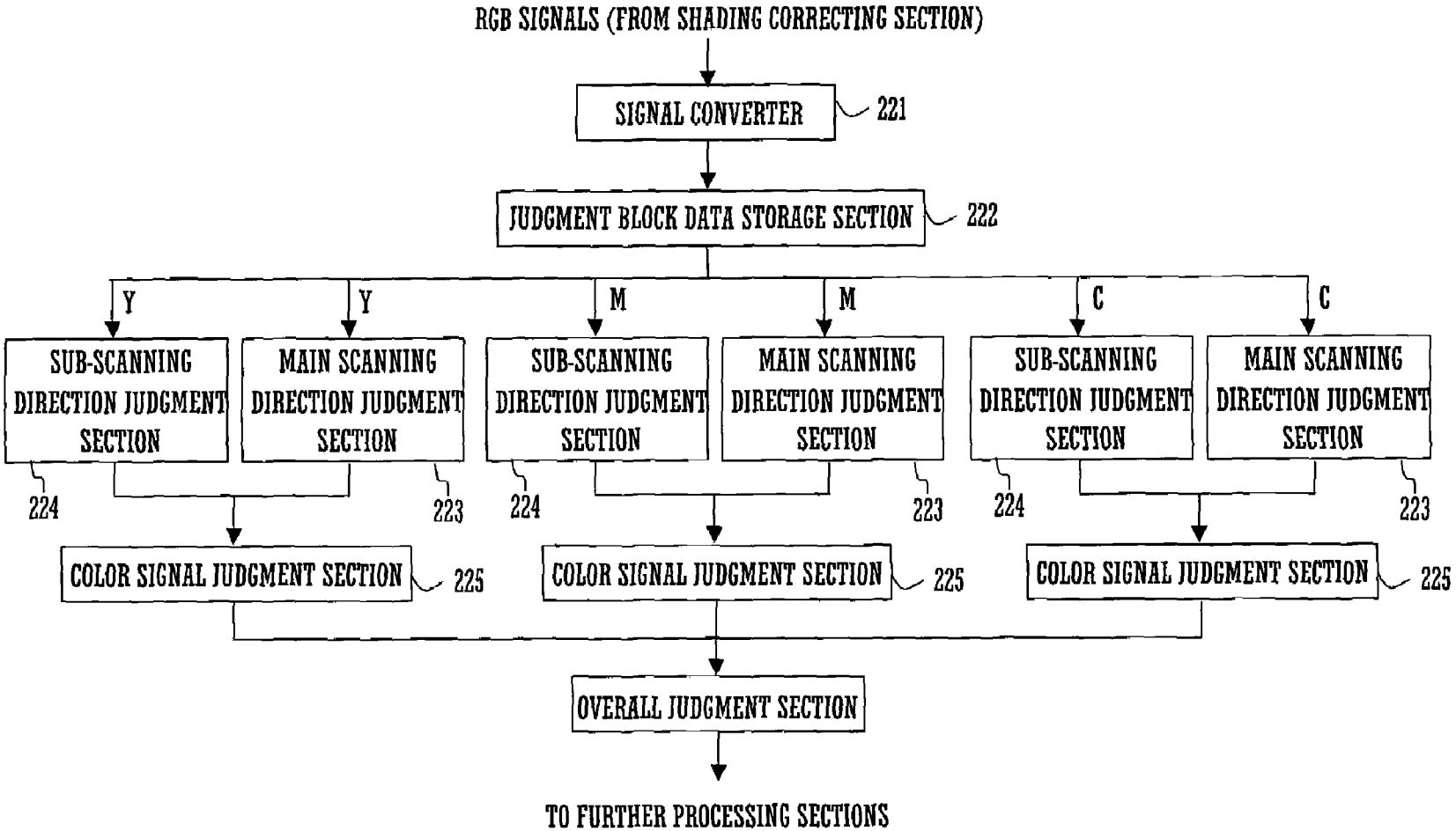
FIG. 6 is a block diagram of an region discriminating section.

To carry out the aforementioned region discriminating process, the region discriminating section includes a signal converter 221, a judgment block data storage section 222, a main scanning direction judgment section 223, a subscanning direction judgment section 224, color signal judgment sections 225 and an overall judgment section 226 as shown in FIG. 6.

The signal converter 221 converts red (R), green (G) and blue (B), or RGB, reflectance signals into RGB density signals and converts the RGB density signals into complementary cyan (C), magenta (M) and yellow (Y), or CMY, signals.

The judgment block data storage section 222 stores image data corresponding to the converted CMY signals derived from the individual blocks each including N×M pixels (e.g., 5×15 pixels).

The main scanning direction judgment section 223 extracts image data including data on the aimed pixels in the individual blocks in the main scanning direction which is perpendicular to scanning lines of the image scanning unit 200 from the individual (CMY) image data stored in the judgment block data storage section 222 and separates the image data into the individual regions (region discriminating process).

The sub-scanning direction judgment section 224 extracts image data including data on the aimed pixels in the individual blocks in the sub-scanning direction which is parallel to the scanning lines of the image scanning unit 200 from the individual (CMY) image data stored in the judgment block data storage section 222 and separates the image data into the individual regions (region discriminating process).

The color signal judgment sections 225 for the three color components (CMY) judge the individual color signals based on results of the region discriminating process performed by the main scanning direction judgment section 223 and the sub-scanning direction judgment section 224 and on priority given to the results of the region discriminating process in the main scanning and sub-scanning directions.

The overall judgment section 226 makes a final judgment on pixels based on the results of judgment by the color signal judgment sections 225 for the individual color components. More specifically, the overall judgment section 226 makes a judgment on characteristics of the color signals including the CMY color components with a certain form of priority assigned to the individual color signals.

A specific order of priority is preassigned to region discrimination signals which are signals for individual pixels input into the color signal judgment sections 225 for the individual color signals (CMY) and into the overall judgment section 226. If the results of judgment on pixels fed into the color signal judgment sections 225 among the individual color signals (CMY), the individual color signal judgment sections 225 and the overall judgment section 226 make the judgment on pixels of the individual color signals (CMY) according to the preassigned order of priority. Since the reliability of the judgment results vary with the size and resolution of the image data in the main scanning and sub-scanning directions stored in the judgment block data storage section 222 and the threshold values used in the region discriminating process, the order of priority should preferably be determined according to the reliability of the judgment results. A reason why the size of the image data varies is that the amounts of data, or the numbers of pixels, in the main scanning and sub-scanning directions vary with the size of each block stored in the judgment block data storage section 222. A further detail of threshold value settings will be explained later.

Figure 7:
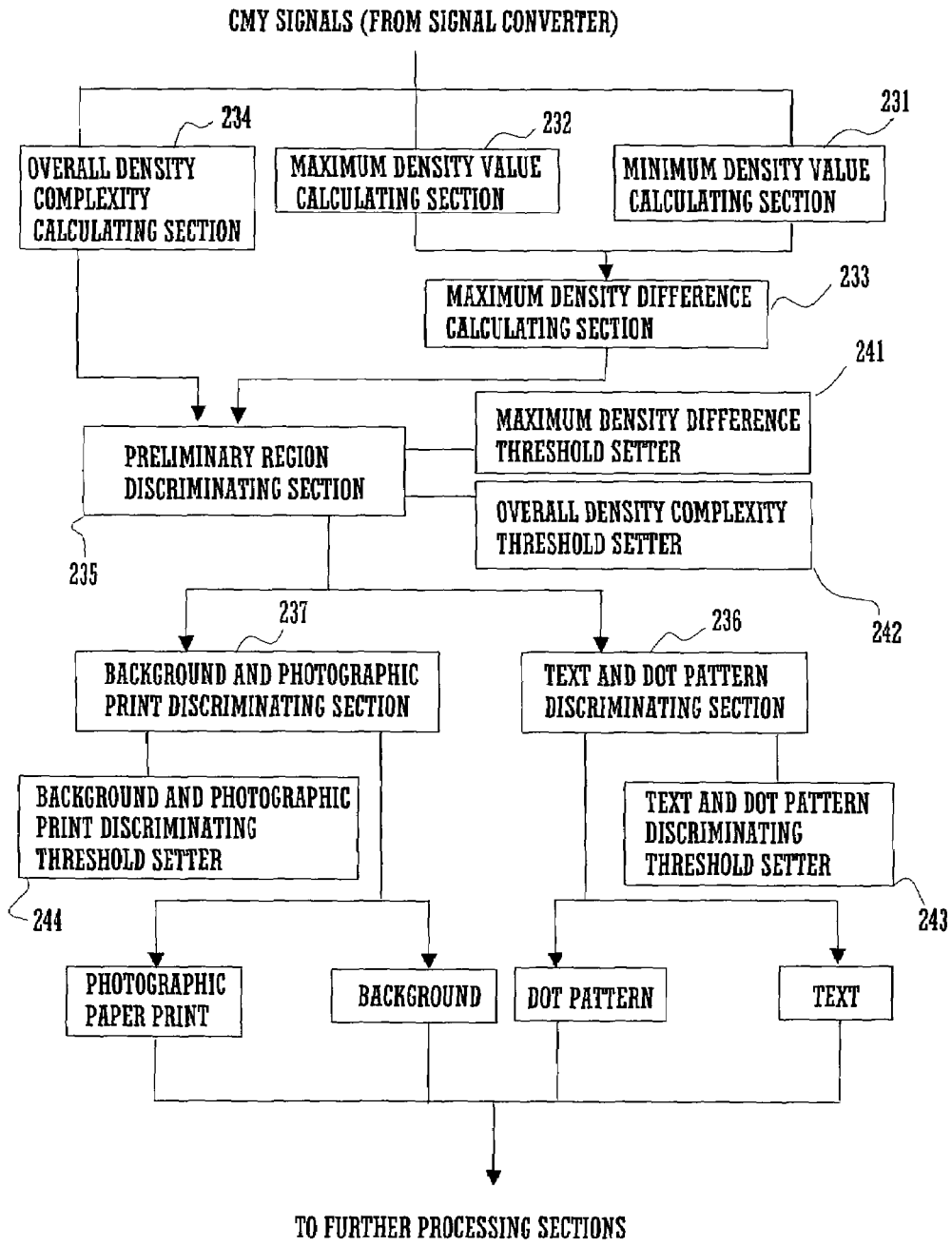
FIG. 7 is a block diagram of a principal part of the region discriminating section of FIG. 6.

A specific construction of the main scanning direction judgment section 223 and the sub-scanning direction judgment section 224 for separating the original image into multiple regions (region discriminating process) in the main scanning and sub-scanning directions is described referring to FIG. 7.

Figure 8:
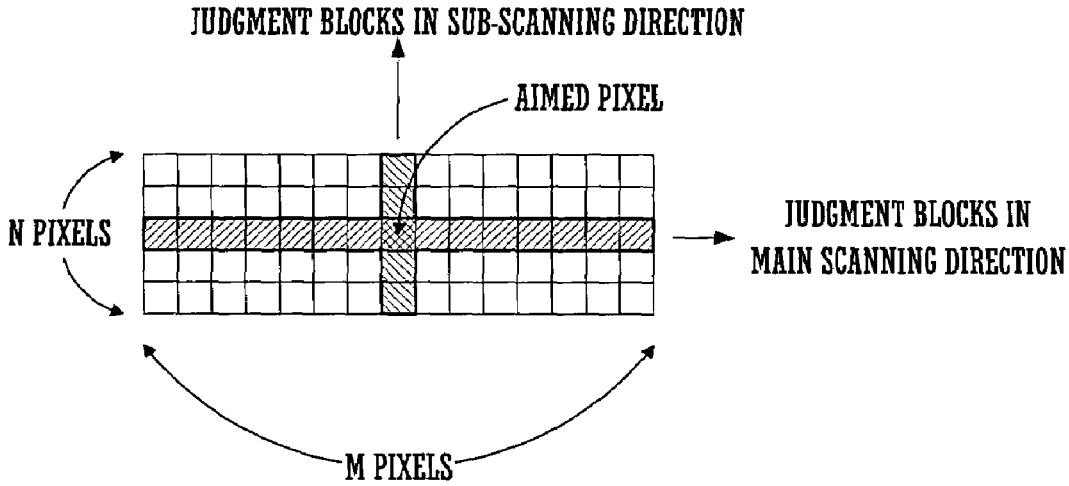
FIG. 8 is an explanatory diagram showing one of judgment blocks used in a region discriminating process.

The main scanning direction judgment section 223 and the sub-scanning direction judgment section 224 have basically the same construction. They only differ in that the main scanning direction judgment section 223 extracts image data including the data on the aimed pixel from pixels arranged in the main scanning direction in each judgment block including N×M pixels (e.g., 5×15 pixels) whereas the sub-scanning direction judgment section 224 extracts image data including the data on the aimed pixel from pixels arranged in the sub-scanning direction in each judgment block including N×M pixels as shown in FIG. 8.

Each of the main scanning direction judgment section 223 and the sub-scanning direction judgment section 224 includes a minimum density value calculating section 231, a maximum density value calculating section 232, a maximum density difference calculating section 233, an overall density complexity calculating section 234, a preliminary region discriminating section 235, a text and dot pattern discriminating section 236, and a background and photographic print discriminating section 237 as shown in FIG. 7.

The minimum density value calculating section 231 calculates a minimum density value in each judgment block while the maximum density value calculating section 232 calculates maximum density value in each judgment block.

The maximum density difference calculating section 233 calculates a maximum density difference from the minimum density value and the maximum density value calculated by the minimum density value calculating section 231 and the maximum density value calculating section 232, respectively.

The overall density complexity calculating section 234 calculates the degree of overall density complexity expressed by the sum of absolute values of density differences between adjacent pixels.

The preliminary region discriminating section 235 determines whether each aimed pixel belongs to a group of text and dot pattern regions or to a group of background and photographic print regions by comparing the maximum density difference calculated by the maximum density difference calculating section 233 and the degree of overall density complexity calculated by the overall density complexity calculating section 234 with respective threshold values.

The text and dot pattern discriminating section 236 determines whether the aimed pixel which has been judged to belong to the group of text and dot pattern regions belongs to a text or dot pattern region.

The background and photographic print discriminating section 237 determines whether the aimed pixel which has been judged to belong to the group of background and photographic print regions belongs to a background or photographic print region.

The preliminary region discriminating section 235 is provided with a maximum density difference threshold setter 241 and an overall density complexity threshold setter 242. The maximum density difference threshold setter 241 sets a maximum density difference threshold value as a first threshold value compared with the maximum density difference calculated by the maximum density difference calculating section 233 for determining whether the aimed pixel belongs the group of text and dot pattern regions or to the group of background and photographic print regions. The overall density complexity threshold setter 242 sets an overall density complexity threshold value as a second threshold value compared with the degree of overall density complexity calculated by the overall density complexity calculating section 234 for determining whether the aimed pixel belongs the group of text and dot pattern regions or to the group of background and photographic print regions.

The background and photographic print discriminating section 237 is provided with a background and photographic print discriminating threshold setter 244 for setting a background and photographic print discriminating threshold value as a third threshold value used for determining whether the aimed pixel which has been judged to belong to the group of background and photographic print regions belongs to a background or photographic print region. Also, the text and dot pattern discriminating section 236 is provided with a text and dot pattern discriminating threshold setter 243 for setting a text and dot pattern discriminating threshold value as a fourth threshold value used for determining whether the aimed pixel which has been judged to belong to the group of text and dot pattern regions belongs to a text or dot pattern region.

Figure 9:
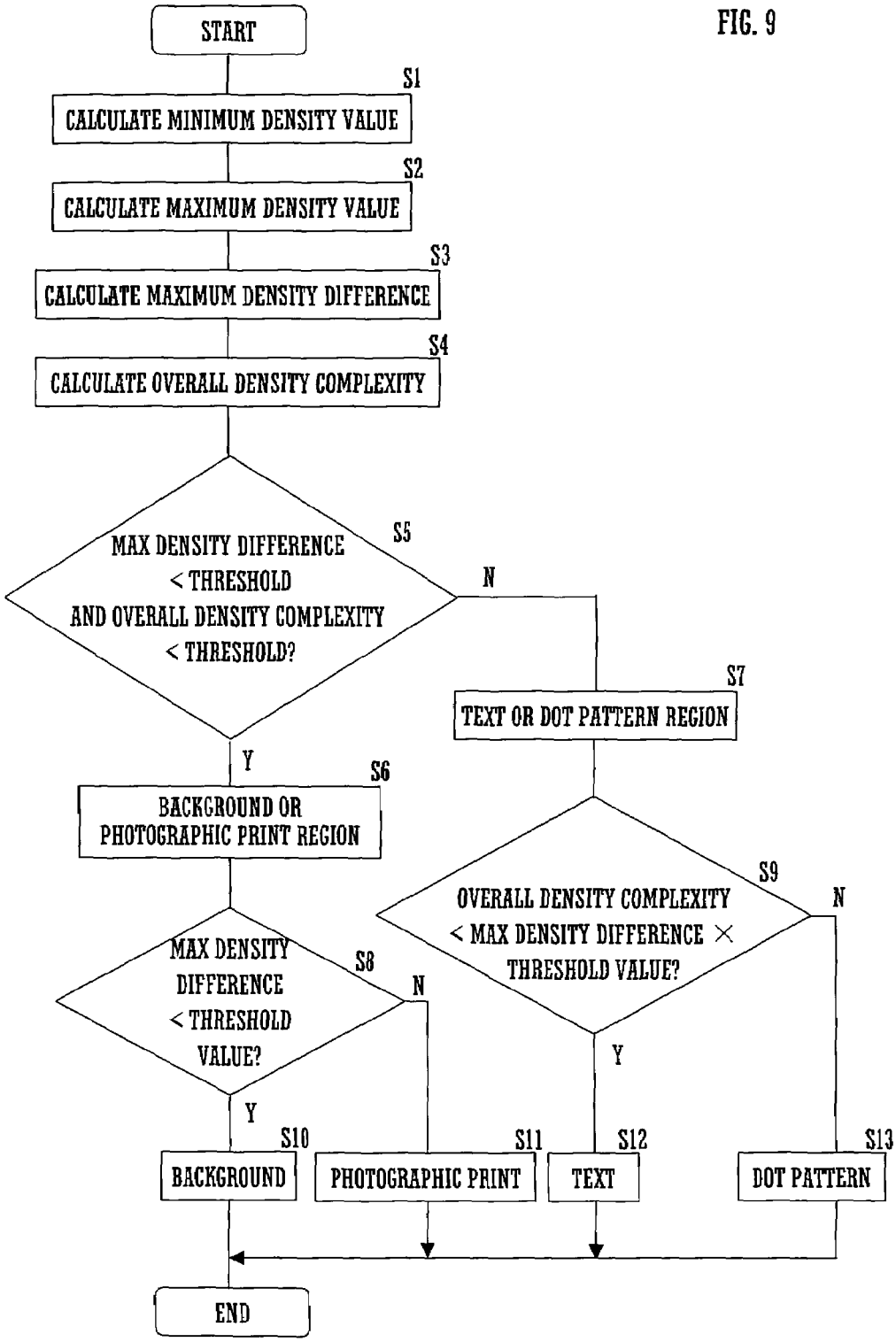
FIG. 9 is a flowchart showing processing steps of the region discriminating process.

The region discriminating process performed by the main scanning direction judgment section 223 and the sub-scanning direction judgment section 224 on each judgment block of N×M pixels including the aimed pixel is now described with reference to a flowchart shown in FIG. 9.

First, the minimum density value calculating section 231 calculates the minimum density value in a judgment block of N×M pixels including the aimed pixel (step S1) and the maximum density value calculating section 232 calculates the maximum density value in the same judgment block (step S2). Then, the maximum density difference calculating section 233 calculates a maximum density difference in the judgment block from the minimum density value and the maximum density value thus calculated (step S3) and the overall density complexity calculating section 234 calculates the degree of overall density complexity expressed by the sum of absolute values of density differences between adjacent pixels (step S4).

Subsequently, the preliminary region discriminating section 235 compares the calculated maximum density difference with the maximum density difference threshold value and the calculated degree of overall density complexity with the overall density complexity threshold value (step S5). If the maximum density difference is judged to be smaller than the maximum density difference threshold value and the degree of overall density complexity is judged to be smaller than the overall density complexity threshold value in step S5, the preliminary region discriminating section 235 judges that the aimed pixel belongs to the group of background and photographic print regions (step S6). If the judgment result in step S5 is in the negative, the preliminary region discriminating section 235 judges that the aimed pixel belongs to the group of text and dot pattern regions (step S7).

If the aimed pixel has been judged to belong to the group of background and photographic print regions (step S6), the background and photographic print discriminating section 237 compares the calculated maximum density difference with the background and photographic print discriminating threshold value (step S8). Then, if the maximum density difference is judged to be smaller than the background and photographic print discriminating threshold value in step S8, the background and photographic print discriminating section 237 judges that the aimed pixel belongs to a background region (step S10). If the maximum density difference is judged to be larger than the background and photographic print discriminating threshold value in step S8, on the other hand, the background and photographic print discriminating section 237 judges that the aimed pixel belongs to a photographic print region (step S11).

If the aimed pixel has been judged to belong to the group of text and dot pattern regions (step S7), the text and dot pattern discriminating section 236 compares the calculated degree of overall density complexity with a product of the maximum density difference times the text and dot pattern discriminating threshold value (step S9). Then, if the calculated degree of overall density complexity is judged to be smaller than the product of the maximum density difference times the text and dot pattern discriminating threshold value, the text and dot pattern discriminating section 236 judges that the aimed pixel belongs to a text region (step S12). If the calculated degree of overall density complexity is judged to be larger than the product of the maximum density difference times the text and dot pattern discriminating threshold value, on the other hand, the text and dot pattern discriminating section 236 judges that the aimed pixel belongs to a dot pattern region (step S13).

The aforementioned region discriminating process is used as a method of distinguishing different types of originals in the present embodiment. Generally, low-resolution image data obtained by prescan is often used for distinguishing various types of originals. The image forming apparatus 100 of this embodiment judges values of pixels picked up along the main scanning direction, disregarding information on pixel values of lower resolution obtained along the sub-scanning direction. The image forming apparatus 100 counts the numbers of pixels judged to belong to individual image regions and determines the type of entire original image by comparing the numbers of pixels belonging to the individual image regions with predefined threshold values for discriminating the background, photographic print, dot pattern and text regions.

More specifically, if the ratio of the number of pixels judged to be text (characters) to the total number of pixels read from an input image data (original image) is equal to or larger than a specific threshold value, the original image is judged to be a text original, for example. A reason why the resolution of image data obtained by prescan is low is that scanning speed in the sub-scanning direction is made lower than that in the main scanning direction when prescanning the original image, and this causes deterioration of the prescanned image data in the sub-scanning direction.

Counts of pixels judged to belong to the background, photographic print, dot pattern and text regions greatly vary with the threshold values used in the aforementioned region discriminating process. If the threshold values for discriminating the background, photographic print, dot pattern and text regions are set corresponding to the threshold values used in the aforementioned region discriminating process and if the counts of pixels satisfy the threshold values predefined for the text region and the dot pattern region, for example, the input image data (original image) can be judged to be a text or dot pattern image.

It is not necessary to judge values of all of the pixels in carrying out the region discriminating process. In one form of the invention, the image forming apparatus 100 may set thresholds of high values for judging pixel values and drop pixels having lower values than the thresholds to achieve high accuracy in judging the pixel values. Needless to say, the threshold values for judging the counts of pixels should be set to low values in this case.

Figure 10:
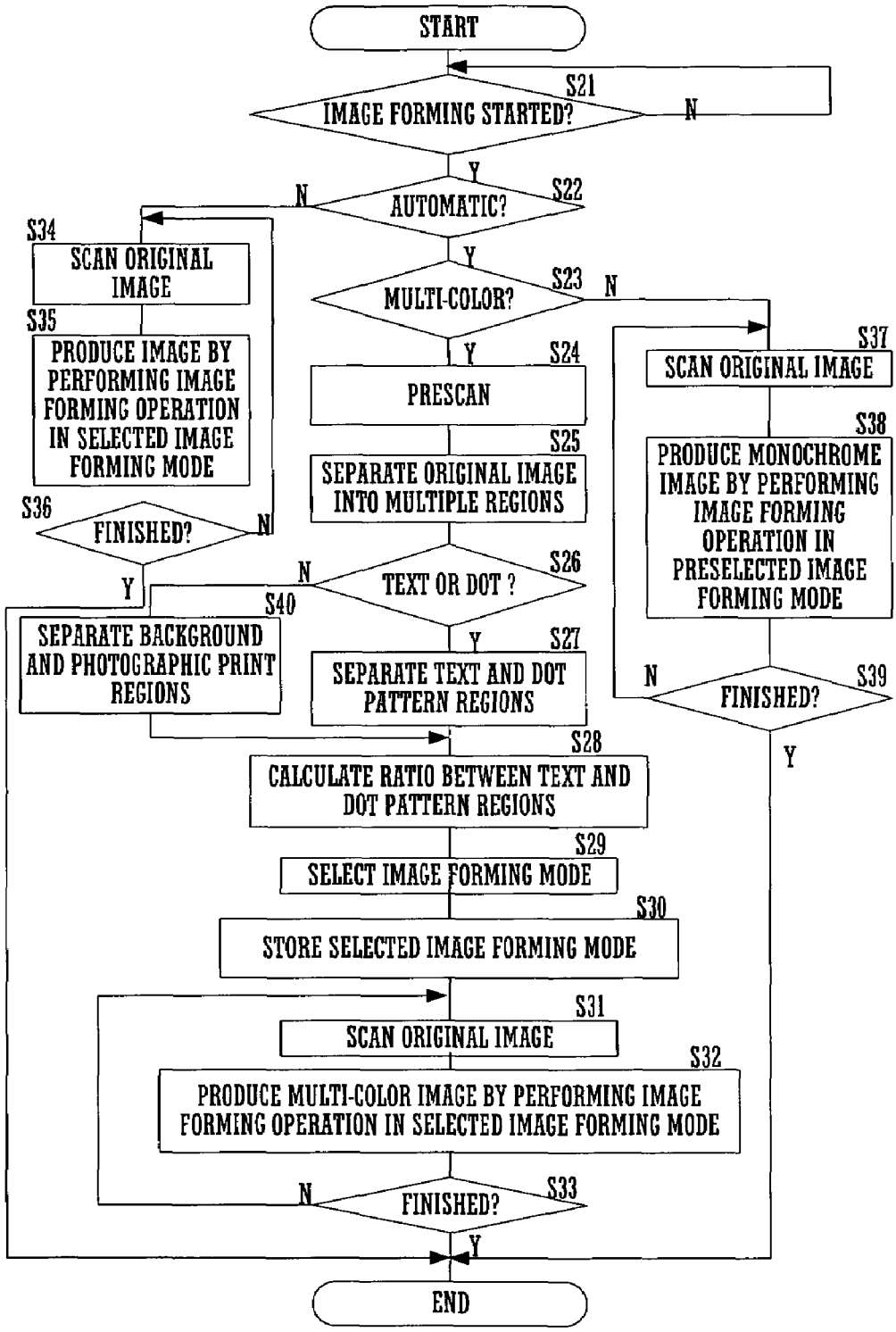
FIG. 10 is a flowchart showing processing steps from the beginning to completion of image forming operation carried out by using the region discriminating process of FIG. 10 for judging types of originals.

FIG. 10 is a flowchart showing an example of a flow of processing steps from the beginning to completion of the image forming operation carried out by using the aforementioned region discriminating process for judging types of originals.

First, the image forming apparatus 100 judges whether the image forming operation has started (step S21). If the judgment result in step S21 is in the affirmative, the image forming apparatus 100 judges whether operation mode currently selected is the automatic operation mode (automatic image forming mode) (step S22). If the automatic operation mode is selected (Yes in step S22), the image forming apparatus 100 judges whether the multi-color image forming operation is to be performed (step S23). If the multi-color image forming operation is selected (Yes in step S23), the image forming apparatus 100 causes the image scanning unit 200 to prescan the original image (step S24).

Next, the region discriminating section separates the original image into multiple regions having different attributes based on image data obtained by prescan (step S25). The region discriminating section then judges whether individual aimed pixels belong to the group of text and dot pattern regions (step S26). If the aimed pixels belong to the group of text and dot pattern regions (Yes in step S26), the aimed pixels are separated into the text and dot pattern regions (step S27) and the ratio between the number of pixels in the text region and the number of pixels in the dot pattern regions is calculated (step S28).

The image forming apparatus 100 determines the image forming mode based on the ratio calculated in step S28 (step S29) and stores the image forming mode in a memory (step S30). Subsequently, the image forming apparatus 100 causes the image scanning unit 200 to scan the original image with normal resolution (step S31) and produces a multi-color image by processing image data in the selected image forming mode (step S32). Then, the image forming apparatus 100 verifies whether the image forming operation including scanning operation has completely finished (step S33).

If the automatic operation mode is not currently selected in step S22, the image forming apparatus 100 proceeds to step S34 and causes the image scanning unit 200 to scan the original image. The image forming apparatus 100 then produces a printed image by processing image data in the currently selected image forming mode (step S35) and verifies whether the image forming operation including scanning operation has completely finished (step S36).

If the image forming apparatus 100 judges that the multi-color image forming operation is not selected (the monochrome image forming operation is selected) in step S23, the image forming apparatus 100 causes the image scanning unit 200 to immediately scan the original image without prescanning it (step S37) and produces a monochrome image by processing image data in the preselected image forming mode (step S38). Then, the image forming apparatus 100 verifies whether the image forming operation including scanning operation has completely finished (step S39).

When the monochrome image processing mode is selected as stated above, the image scanning unit 200 is caused to immediately scan the original image without prescanning it, so that the time needed for the image processing operation can be reduced. When the multi-color image processing mode is selected, on the other hand, the type of original is distinguished by the region discriminating process using the image data obtained by prescanning the original image and appropriate image processing parameters are selected, so that the image forming apparatus 100 can produce a high-quality printed image.

The present invention is not limited to the aforementioned region discriminating process. The invention is applicable to an image forming apparatus regardless of its construction or processing method as long as the type of original can be distinguished to such an extent that allows selection of image processing parameters suited to the original based on the image data obtained by prescanning the original image at least when the multi-color image processing mode is selected.

The image forming apparatus 100 of the foregoing embodiment determines whether or not to prescan the original based on whether monochrome or multi-color image processing is selected when the automatic image forming mode is selected. This enables the image forming apparatus 100 to properly perform the image forming operation, whether it be monochrome or multi-color.

When the monochrome image processing mode is selected, for example, the image forming apparatus 100 immediately causes the image scanning unit 200 to begin scanning the original image without prescanning it and performs the image processing operation. It is therefore possible to reduce the time needed for the image forming operation. When the multi-color image processing mode is selected, on the other hand, the image forming apparatus 100 is switched to appropriate image processing settings upon completion of the aforementioned prescanning operation, so that the image forming apparatus 100 can perform the image forming operation in an optimum fashion after prescanning. Therefore, the image forming apparatus 100 can produce printed images of high quality by performing the image processing operation in a manner suited to individual types of originals.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus comprising:

a selector for allowing a user to select whether to perform monochrome or multi-color image processing operation on image data obtained by scanning an original image;

an automatic image forming mode setting section for defining image forming conditions including such parameters as copying density which are automatically set in automatic image forming mode; and a controller for outputting, depending on whether the user has selected the monochrome or multi-color image processing operation through the selector, a control signal indicating whether or not to prescan the original image for distinguishing the type of original when the automatic image forming mode is selected to use the image forming conditions defined in the automatic image forming mode setting section.

2. The image forming apparatus according to claim 1, wherein the controller causes said image forming apparatus to perform image forming operation without prescanning the original image when the user has selected the monochrome image processing operation through the selector, and the controller causes said image forming apparatus to perform the image forming operation after prescanning the original image when the user has selected the multi-color image processing operation through the selector.

3. The image forming apparatus according to claim 2, the selector including:

a first selector portion for selecting the monochrome image processing operation; and a second selector portion for selecting the multi-color image processing operation;

wherein the first and second selector portions serve also as image processing starting devices for initiating the image forming operation.

4. The image forming apparatus according to claim 2, wherein the controller causes said image forming apparatus to perform the image forming operation using predefined monochrome image processing parameters when the user has selected the monochrome image processing operation through the selector.

5. The image forming apparatus according to claim 4 further comprising:

a parameter setting section which enables the controller to select the monochrome image processing parameters to be set for performing the image forming operation from multiple sets of predefined image processing parameters.

6. The image forming apparatus according to claim 2, the controller including:

a region discriminating section for separating image data obtained by prescanning the original image into multiple image regions having different attributes representing types of images such as text, halftone dot and background;

wherein the controller selects image processing parameters from multiple sets of predefined image processing parameters based on image quantity values of the individual image regions in which the prescanned image data has been separated by the region discriminating section when the user has selected the multi-color image processing operation through the selector, and the controller causes said image forming apparatus to perform the image forming operation using the selected image processing parameters.

7. The image forming apparatus according to claim 1 further comprising:

a platen glass; and an image scanner for obtaining the image data by scanning the original image placed on the platen glass.

* * * * *